US011035655B2

(12) United States Patent
Paesch et al.

(10) Patent No.: US 11,035,655 B2
(45) Date of Patent: Jun. 15, 2021

(54) OBTURATOR, WHICH IS AN INTEGRAL PART OF THE DRIVING BAND, ON AN ARTILLERY PROJECTILE

(71) Applicant: RHEINMETALL WAFFE MUNITION GMBH, Unterluess (DE)

(72) Inventors: Alexander Paesch, Celle (DE); Ole Dau, Reppenstedt (DE); Alfons Sackarndt, Suderburg (DE)

(73) Assignee: Rheinmetall Waffe Munition GmbH, Uterluess (DE)

( * ) Notice: Subject to any disclaimer, the term of this patent is extended or adjusted under 35 U.S.C. 154(b) by 0 days.

(21) Appl. No.: 16/681,343

(22) Filed: Nov. 12, 2019

(65) Prior Publication Data

US 2020/0080823 A1 Mar. 12, 2020

Related U.S. Application Data

(63) Continuation of application No. PCT/EP2018/057764, filed on Mar. 27, 2018.

(30) Foreign Application Priority Data

May 12, 2017 (DE) ..... 10 2017 110 426.7

(51) Int. Cl.
*F42B 14/02* (2006.01)

(52) U.S. Cl.
CPC ..... *F42B 14/02* (2013.01)

(58) Field of Classification Search
CPC ..... F42B 14/02
USPC ..... 102/524
See application file for complete search history.

(56) References Cited

U.S. PATENT DOCUMENTS 32,949 A * 7/1861 Lindner ..... F42B 14/02 102/525
2,856,856 A * 10/1958 Michael ..... F42B 14/02 102/526
2,996,012 A * 8/1961 Butler ..... F42B 14/02 102/527
3,431,815 A * 3/1969 Kaufmann, Jr. ..... F42B 14/08 89/1.1
3,744,426 A * 7/1973 Butler ..... F42B 14/02 102/527

(Continued)

FOREIGN PATENT DOCUMENTS

CH 45337 A 11/1909
CN 103071891 B 5/2013

(Continued)

OTHER PUBLICATIONS

International Search Report dated Apr. 6, 2018 in corresponding application PCT/EP2018/057764.

*Primary Examiner* — Joshua E Freeman
(74) *Attorney, Agent, or Firm* — Muncy, Geissler, Olds & Lowe, P.C.

(57) ABSTRACT

A spin-stabilized artillery projectile having at least one driving band and at least one obturator, wherein the driving band contains at least one compensating groove, and wherein the at least one obturator is arranged in the compensating groove of the driving band. The cross-section of the compensating groove, is preferably trapezoidal, but can also be rectangular or square. As a result, a complete detachment of the obturator is achieved and residues are avoided.

9 Claims, 1 Drawing Sheet

(56) References Cited

U.S. PATENT DOCUMENTS

| | | | | |
|---|---|---|---|---|
| 4,441,429 | A * | 4/1984 | Price | F42B 14/02 102/501 |
| 4,532,868 | A | 8/1985 | Gleichaut et al. | |
| 4,552,071 | A * | 11/1985 | Horais | F42B 14/02 102/524 |
| 5,081,931 | A * | 1/1992 | Frye | F42B 14/02 102/473 |
| 5,449,874 | A | 9/1995 | Altenau | |
| 6,401,622 | B1 * | 6/2002 | Brinkmann | F42B 14/02 102/524 |
| 6,412,419 | B1 * | 7/2002 | Brinkmann | F42B 14/02 102/524 |
| 6,536,353 | B1 * | 3/2003 | Fischer | F42B 14/02 102/526 |
| 6,796,068 | B2 * | 9/2004 | Crowson | F42B 14/00 102/520 |
| 2003/0145757 | A1 * | 8/2003 | Fischer | F42B 14/02 102/526 |
| 2014/0076191 | A1 * | 3/2014 | Abeln | F42B 10/26 102/526 |

FOREIGN PATENT DOCUMENTS

| | | | |
|---|---|---|---|
| DE | 669858 | C | 12/1938 |
| DE | 3248011 | C1 | 9/1984 |
| DE | 3913497 | A1 | 12/1989 |
| DE | 4000167 | C2 | 7/1991 |
| DE | 4330416 | A1 | 3/1995 |
| DE | 19855535 | A1 | 6/2000 |
| DE | 19855536 | A1 | 6/2000 |
| DE | 202014005442 | U1 | 8/2014 |
| EP | 2529180 | B1 | 12/2012 |
| FR | 689095 | A | 9/1930 |
| GB | 574049 | A | 12/1945 |

* cited by examiner

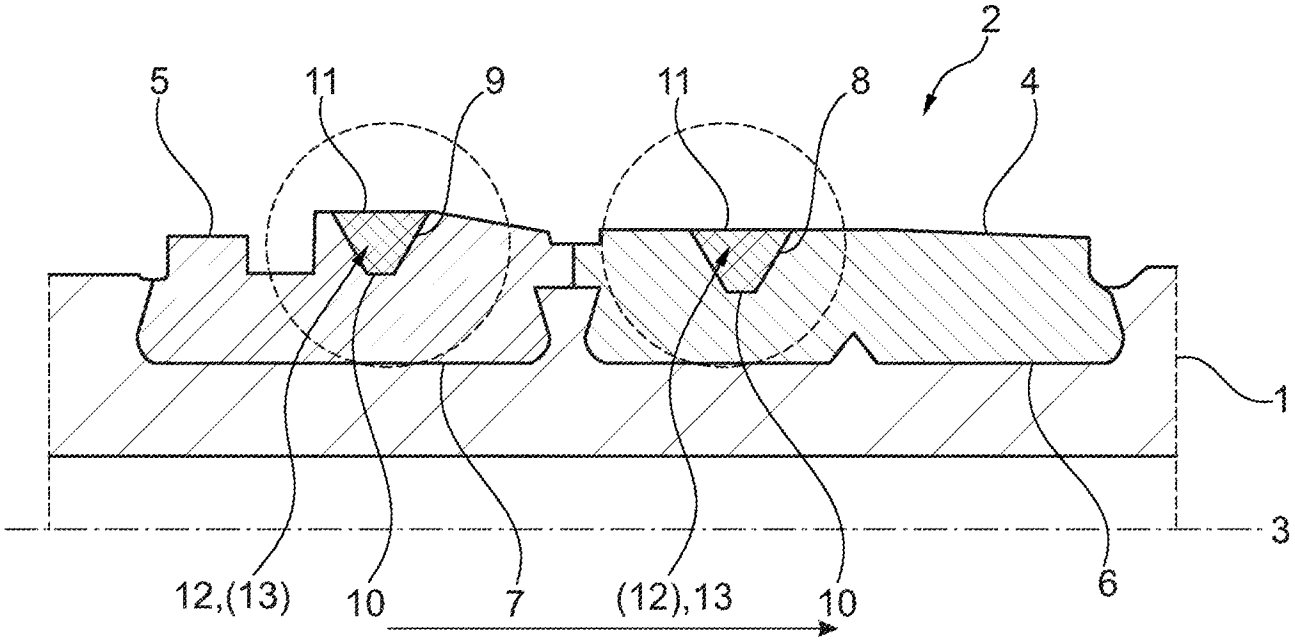
1
3
2
4
6
8
10
11
(12),13
9
7
11
10
12,(13)
5

OBTURATOR, WHICH IS AN INTEGRAL PART OF THE DRIVING BAND, ON AN ARTILLERY PROJECTILE

This nonprovisional application is a continuation of International Application No. PCT/EP2018/057764, which was filed on Mar. 27, 2018, and which claims priority to German Patent Application No. 10 2017 110 426.7, which was filed in Germany on May 12, 2017, and which are both herein incorporated by reference.

BACKGROUND OF THE INVENTION

Field of the Invention

The present invention relates to a spin stabilized projectile, in particular an artillery projectile with a driving band and with a sealing band, i.e. an obturator.

Description of the Background Art

An obturator has the function of a sealing ring, with which its full sealing performance is only achieved under appropriate pressure loading. The technical requirements for such a component are predetermined and binding.

When passing through the barrel, due to the design conditions, a temporary form-fitting connection is made of rearward displaced driving band material with an obturator (ring). However, this form-fitting connection is usually removed mechanically, primarily by the centrifugal force that becomes effective when passing through the muzzle, but this is not sufficiently reliable, especially with a small charge and at the operating corner temperature. This can sometimes lead to significant losses in accuracy.

The susceptibility of the known solutions in the automatic flow of ammunition (in the loading process) is significant. Obturator (ring) damage occurs up to the destruction of the obturator. The disadvantage is that the resulting loose fragments of the obturator can block the gun mechanism. Also in the manual flow of ammunition, before the loading process, pre-damage of the obturator also occurs equally frequently. This is often due to the fact that when a driving band protection ring is removed, the obturator can also be negatively affected.

DE 669 858 shows an artillery projectile with a driving band pressed into an annular groove of the projectile shell.

Artillery ammunition is known from EP 2 529 180 B1, which corresponds to US 2014/0076191, which is incorporated herein by reference, and which has a rear driving band that is embodied in multiple parts. The partial driving bands are inserted into separate dovetail grooves, such that the partial driving bands adjoin each other directly. This better distributes the centrifugal forces that occur. The partial driving bands are designed to allow the material to flow during the passage through the barrel.

A sealing ring of DE 20 2014 005 442 U1 is disposed at the rear of the driving band and is held in an outer groove of the projectile shell.

From DE 198 55 536 A1, which corresponds to U.S. Pat. No. 6,401,622, which is incorporated herein by reference, a spin-stabilized artillery projectile is known that has a metallic driving band and a sealing ring disposed to the rear of the driving band to transfer the spin to the projectile. In order to safely prevent damage to or destruction of or tearing off of the sealing ring when inserting the projectile into the loading chamber of the corresponding weapon, the sealing ring is designed as a metal ring, which is arranged in an annular groove of the projectile in such a way that it can rotate freely relative to the projectile. This solution has proven itself in practice. However, alternatives are always desirable.

From DE 40 00 167 C2, which corresponds to U.S. Pat. No. 5,081,931, which is incorporated herein by reference, a spin-stabilized carrier projectile is known with a metallic driving band and a sealing ring made of plastic disposed behind it for complete sealing. A plastic attachment ring is disposed in front of the metallic driving band in the firing direction. The attachment ring contains an end support surface, which rests in contact with a parallel end face of the driving band in the axial rearward-pointing direction. The separation of the attachment ring is carried out by at least one longitudinal slot disposed in the casing area immediately when exiting the weapon barrel.

DE 198 55 535 A1, which corresponds to U.S. Pat. No. 6,412,419, which is incorporated herein by reference, describes a spin-stabilized artillery projectile with a metallic driving band and a sealing ring made of plastic. The driving band, when viewed in the direction of the longitudinal axis of the projectile, has at least one annular groove in which the sealing ring is disposed and is connected to the projectile wall by form locking and force locking. Mechanical damage or destruction or stripping off of the sealing ring is intended to be prevented safely as a result and the sealing function thereof is not negatively affected.

SUMMARY OF THE INVENTION

It is therefore an object of the present invention to convert the disadvantage of the known solutions into an advantage. A complete detachment of the sealing ring or obturator is expressly desired according to the invention.

For this purpose, a design configuration of an interface between a rear edge of a driving band and a front edge of an obturator or sealing ring is carried out, which favors complete detachment of the obturator after the passage through the muzzle. The obturator is an integral part of a driving band according to the invention. The function of the obturator is firmly integrated into the driving band structure. There is no force-locking or shape-locking connection to the projectile wall. The obturator is preferably made of plastic, for example polyamide.

The projectile comprises a driving band or driving band structure formed of one or individual pressed or welded-on ring(s). The positioning of the obturator takes place in at least one groove or equalizing groove in the driving band or the driving band structure. The equalizing groove in the driving band or the equalizing grooves in the drive band structure are preferably central, but at least such that during the passage through the barrel the rearward oriented driving band material pushes the obturator/the sealing ring backwards or upwards out of the equalizing groove.

The equalizing groove can be trapezoidal in cross-section, preferably equilateral. The equalizing groove has a narrower surface pointing towards the projectile than towards the weapon barrel, which results in the trapezoidal shape. This trapezoidal shape facilitates the detachment of the obturator or sealing ring during the passage through the barrel. During the passage through the barrel, the sealing ring is pushed backwards or upwards like an O-ring out of the equalizing groove by the rearward-oriented driving band material. This action results in a sealing effect during the passage through the barrel. The obturator/sealing ring itself no longer exists as an individual part. Only one gas-flow-reducing element remains in the driving band in order to keep the pressure and the resulting velocity dispersions as low as possible. A centrifugal force-induced release after the passage through the muzzle is greatly simplified by the trapezoidal shape.

The equalizing groove can also be rectangular or square in section.

Excess material does not result in an aerodynamically negatively relevant protrusion, i.e., the material that protrudes from an obturator groove and negatively affects the aerodynamics, since the metallic driving band region behind the positioning of the plastic acts like a cutting die and scrapes off the sealing ring over the surface or even strips it off. Brass and/or iron are preferably used as the metallic material. But copper has also proven its worth.

By a corresponding design of the puncture depth of the equalizing groove in the driving band or in the driving band structure and thus of the sealing insert, it is achieved that no fragments of the plastic ring remain after the passage through the barrel due to the tensile field profile, since said fragments are intentionally completely depleted in the shear and deformation plane of the tensile field profile.

The plastic ring or sealing ring as an integral function-relevant component of the projectile is much more robust and less prone to failure. Even untrained users clearly recognize that the plastic ring does not serve as protection for the driving band, since the plastic ring is not on the driving band but is inserted into it. The driving material displaced rearwards during the passage through the barrel collides intentionally with the sealing ring material in the drive band equalizing groove, because this collision raises the dichtmetrial and additionally presses the sealing material against the barrel wall with an extreme sealing effect.

A spin-stabilized artillery projectile with a driving band and at least one obturator is proposed. The driving band contains at least one equalizing groove when viewed in the direction of a longitudinal axis (3) of the projectile. The at least one obturator is disposed in the at least one equalizing groove of the driving band. The cross-section of the equalizing groove is preferably trapezoidal but can also be rectangular or square. This achieves complete detachment of the obturator, wherein residues are avoided.

This invention is also advantageous in that it is simple and uncomplicated. The solution is robust against external influences. Remaining plastic residues on the projectile are avoided when the task as an obturator is carried out.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which are given by way of illustration only, and thus, are not limitive of the present invention, and wherein the sole FIGURE shows a cross-section of a spin-stabilized projectile according to an exemplary embodiment of the invention.

DETAILED DESCRIPTION

The FIGURE shows the cross-section of a spin-stabilized artillery projectile 1 in the region of a driving band 2, for example formed of brass.

In the present embodiment, the driving band 2 is made up of at least two driving band parts 4, 5—when viewed in the direction of a longitudinal axis 3 of the projectile 1.

If the driving band is a two-piece band, it usually is formed of two materials, for example brass and/or iron.

The driving band parts 4, 5 are inserted into respective grooves 6, 7 in the projectile 1. Said grooves 6, 7 preferably have a dovetail shape.

The driving band 2 can also be implemented in one piece. Welding of the driving band 2 (4, 5) is also possible.

An equalizing groove 8, 9 is introduced into each respective driving band part 4, 5. Said equalizing groove 8, 9 preferably has a trapezoidal shape in cross-section. The narrow side 10 (smaller area) is pointing towards the longitudinal axis 3. The wider side 11 (larger area) terminates with the driving band parts 4, 5, preferably without protruding and thus flush with the surface.

A preferably plastic sealing ring or obturator 12, 13 is disposed in each equalizing groove 8, 9. The shape of the obturator 12, 13 is adapted to the corresponding equalizing groove 8, 9.

During the passage through the barrel, the rearward-oriented driving band material of the driving band parts of the obturator 12, 13 is pressed rearwards or upwards out of the equalizing groove 8, 9 like an O-ring. This forms a seal during the passage through the barrel. The metallic driving band region behind the positioning of the obturator 12, 13 shears it off, so that the obturator 12, 13 is no longer part of the driving band 2 (4, 5) when the artillery projectile 1 exits from the weapon barrel.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A spin-stabilized artillery projectile comprising:

a driving band; and at least one obturator, wherein the driving band, when viewed in a direction of a longitudinal axis of the projectile, contains at least one equalizing groove, wherein the at least one obturator is disposed in the equalizing groove of the driving band;

wherein an outer surface of the at least one obturator is aligned with an outer surface of the driving band, such that the outer surface of the at least one obturator does not protrude beyond the outer surface of the driving band;

wherein a cross-section of the at least one equalizing groove is shaped as an equilateral trapezoid, and wherein the equilateral trapezoid has a narrow side and a wide side that opposes the narrow side and wherein the narrow side of the equilateral trapezoid is positioned closer to the longitudinal axis of the projectile than the wide side, such that, as the projectile passes through a gun barrel, the at least one obturator is able to be pushed upward out of the at least one equalizing groove to be sheared off by a portion of the driving band positioned behind the at least one equalizing groove.

2. The spin-stabilized artillery projectile according to claim 1, wherein the at least one equalizing groove includes two equalizing grooves disposed on the driving band.

3. The spin-stabilized artillery projectile according to claim 2, wherein the driving band is formed of at least two driving band parts.

4. The spin-stabilized artillery projectile according to claim 3, wherein each of the at least two driving band parts include one of the two equalizing grooves.

5. The spin-stabilized artillery projectile according to claim 3, wherein the driving band or the at least two driving band parts are inserted into grooves of the projectile, which have a dovetail shape.

6. The spin-stabilized artillery projectile according to claim 3, wherein the driving band or the at least two driving band parts are welded or soldered.

7. The spin-stabilized artillery projectile according to claim 1, wherein the driving band is formed of brass and/or iron.

8. The spin-stabilized artillery projectile according to claim 1, wherein the at least one obturator is formed of plastic or polyamide.

9. The spin-stabilized artillery projectile according to claim 1, wherein the at least one obturator is made of plastic and the driving band is made of metal.

* * * * *